US008118403B2

(12) United States Patent
Lee et al.

(10) Patent No.: US 8,118,403 B2
(45) Date of Patent: Feb. 21, 2012

(54) INKJET PRINTHEAD AND METHOD OF MANUFACTURING THE SAME

(75) Inventors: Jin-wook Lee, Seoul (KR); Chang-shin Park, Seongnam-si (KR); Sung-jun Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 484 days.

(21) Appl. No.: 12/351,004

(22) Filed: Jan. 9, 2009

(65) Prior Publication Data

US 2010/0033536 A1 Feb. 11, 2010

(30) Foreign Application Priority Data

Aug. 11, 2008 (KR) ..... 2008-78521

(51) Int. Cl.
*B41J 2/14* (2006.01)

(52) U.S. Cl. ..... 347/47

(58) Field of Classification Search ..... 347/40, 347/43, 47

See application file for complete search history.

(56) References Cited

U.S. PATENT DOCUMENTS

2007/0070122 A1 3/2007 Bertelsen et al.

FOREIGN PATENT DOCUMENTS

KR 20040019461 3/2004

*Primary Examiner* — Lamson Nguyen

(74) *Attorney, Agent, or Firm* — Stanzione & Kim, LLP

(57) ABSTRACT

An inkjet printhead and a method of manufacturing the inkjet printhead. In the inkjet printhead, an anti reflective layer is formed of a material absorbing light on a chamber layer, and a nozzle layer including a plurality of nozzles is formed on the anti reflective layer.

23 Claims, 8 Drawing Sheets

INKJET PRINTHEAD AND METHOD OF MANUFACTURING THE SAME

CROSS-REFERENCE TO RELATED APPLICATIONS

This application claims priority under 35 U.S.C. §119 from Korean Patent Application No. 10-2008-0078521, filed on Aug. 11, 2008, in the Korean Intellectual Property Office, the disclosure of which is incorporated herein in its entirety by reference.

BACKGROUND OF THE INVENTION

1. Field of the Invention

The present general inventive concept relates to a thermal inkjet printhead, an image forming apparatus having the same, and a method of manufacturing the thermal inkjet printhead.

2. Description of the Related Art

Generally, inkjet printers print a color image on a printing medium by ejecting ink droplets onto a desired region of the printing medium. Inkjet printers can be classified into shuttle type inkjet printers that perform printing jobs by moving a printing head in a processing direction of a printing medium and a perpendicular direction to the processing direction, and line printing type inkjet printers including printheads having a size corresponding to the width of a printing medium. Since line printing type inkjet printers perform printing jobs when the printheads are fixed and only the printing medium is processed, line printing type inkjet printers can print at high speed. Line printing type inkjet printers can include a single printhead or a plurality of printheads, having a length substantially corresponding to the width of printing paper. In this case, when the sum of the lengths of the plurality of printhead substantially corresponds to the width of printing paper, the plurality of printheads are referred to as an array type inkjet printhead.

Depending on the ink ejecting method, inkjet printheads can be classified into two types: thermal inkjet printheads and piezoelectric inkjet printheads. The thermal inkjet printhead generates bubbles in the ink to be ejected using heat, and ejects the ink using the expansion of the bubbles. On the other hand, the piezoelectric inkjet printhead ejects ink using a pressure generated by deforming a piezoelectric material.

The ink droplet ejecting mechanism of the thermal inkjet printhead will now be described in more detail. When a current pulse flows through a heater, the heater generates heat, and thus the ink adjacent to the heater is heated instantly to a temperature of about 300° C. Accordingly, the ink boils and generates bubbles, which expand and thus press the ink in an ink chamber. Therefore, the ink is ejected out of the ink chamber through nozzles in the shape of droplets.

SUMMARY OF THE INVENTION

The present general inventive concept provides an inkjet printhead, an image forming apparatus, and a method of manufacturing the inkjet printhead.

Additional aspects and utilities of the present general inventive concept will be set forth in part in the description which follows and, in part, will be obvious from the description, or may be learned by practice of the general inventive concept.

In an embodiment and utilities of the present general inventive concept, there is provided an inkjet printhead including a substrate; a chamber layer formed on the substrate and including a plurality of ink chambers; an anti reflective layer formed of a material absorbing light on the chamber layer; and a nozzle layer formed on the anti reflective layer and including a plurality of nozzles.

A light transmissivity of the anti reflective layer may be smaller than a light transmissivity of the chamber layer or the nozzle layer. The anti reflective layer may include a plurality of through holes formed therethrough and connected to the nozzles.

The nozzle layer may include a photosensitive dry film. The photosensitive dry film may include a negative photoresist. The chamber layer may include a photosensitive polymer.

A composite layer of the anti reflective layer and the nozzle layer, which is manufactured in a film form, may be formed on the chamber layer.

The inkjet printhead may further include an ink feed hole supplying ink to the ink chamber and formed in the substrate.

The inkjet printhead may further include an insulating layer formed on the substrate; a plurality of heaters and a plurality of electrodes, sequentially formed on the insulating layer; and a passivation layer formed so as to cover the heaters and the electrodes. The inkjet printhead may further include an anti-cavitation layer formed on the passivation layer and protecting the heater from a cavitation force generated when bubbles collapse In an embodiment and utilities of the present general inventive concept, there is also provided a method of manufacturing an inkjet printhead, the method including forming a chamber layer having a plurality of ink chambers on a substrate; stacking an anti reflective material layer formed of a material absorbing light and a nozzle material layer on the chamber layer; and forming a nozzle layer including a plurality of nozzles and an anti reflective layer including a plurality of through holes.

The chamber layer may be formed by forming a chamber material layer including a liquid photosensitive polymer or a photosensitive dry film and patterning the chamber material layer.

The stacking of the anti reflective material layer and the nozzle material layer may include laminating a composite layer of the anti reflective material layer and the nozzle material layer, which is manufactured in a film form, on the chamber layer.

The forming of the nozzle layer and the anti reflective layer may include forming the nozzle layer including the nozzles by exposing and developing the nozzle material layer; and forming the anti reflective layer including the through holes connected to the nozzles by removing the anti reflective material layer exposed through the nozzles.

The forming of the nozzle layer and the anti reflective material layer may include forming the nozzle layer including the nozzles and the anti reflective layer including the through holes connected to the nozzle by exposing and developing the nozzle material layer.

According to the present general inventive concept, a nozzle having a uniform shape can be obtained by forming an anti reflective layer of a material absorbing light between a chamber layer and a nozzle layer, thereby realizing an inkjet printhead having stable ejection properties.

In an embodiment and utilities of the present general inventive concept, there is also provided an image forming apparatus including a feeding unit to feed a printing medium along a path, a printing unit including a print head having a substrate, a chamber layer formed on the substrate and including a plurality of ink chambers, an anti reflective layer formed of a material absorbing light on the chamber layer, and a nozzle layer formed on the anti reflective layer and including a plurality of nozzles, and to form an image on the printing medium, and a discharge unit to discharge the printing medium.

In an embodiment and utilities of the present general inventive concept, there is also provided an inkjet printhead including a substrate, a chamber layer formed on the substrate to form an ink chamber, a nozzle layer formed on the chamber layer, and an anti reflective layer formed of a material having a light reflecting characteristic between the chamber layer and the nozzle layer.

In an embodiment and utilities of the present general inventive concept, there is also provided an inkjet printhead including a nozzle layer having a nozzle, and an anti reflective layer attached to the nozzle layer to reflect light passing the nozzle layer back toward the nozzle layer.

In an embodiment and utilities of the present general inventive concept, there is also provided an inkjet printhead including a nozzle layer having a nozzle, and an anti reflective layer formed on the nozzle layer and having a light reflecting characteristic different from a light transmitting characteristic of the nozzle layer.

In an embodiment and utilities of the present general inventive concept, there is also provided an inkjet printhead including a chamber layer, a nozzle layer having a nozzle and to define an ink chamber with the nozzle layer, and an anti reflective layer to reflect light such that the light passing the nozzle layer is prevented from being incident into the ink chamber.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
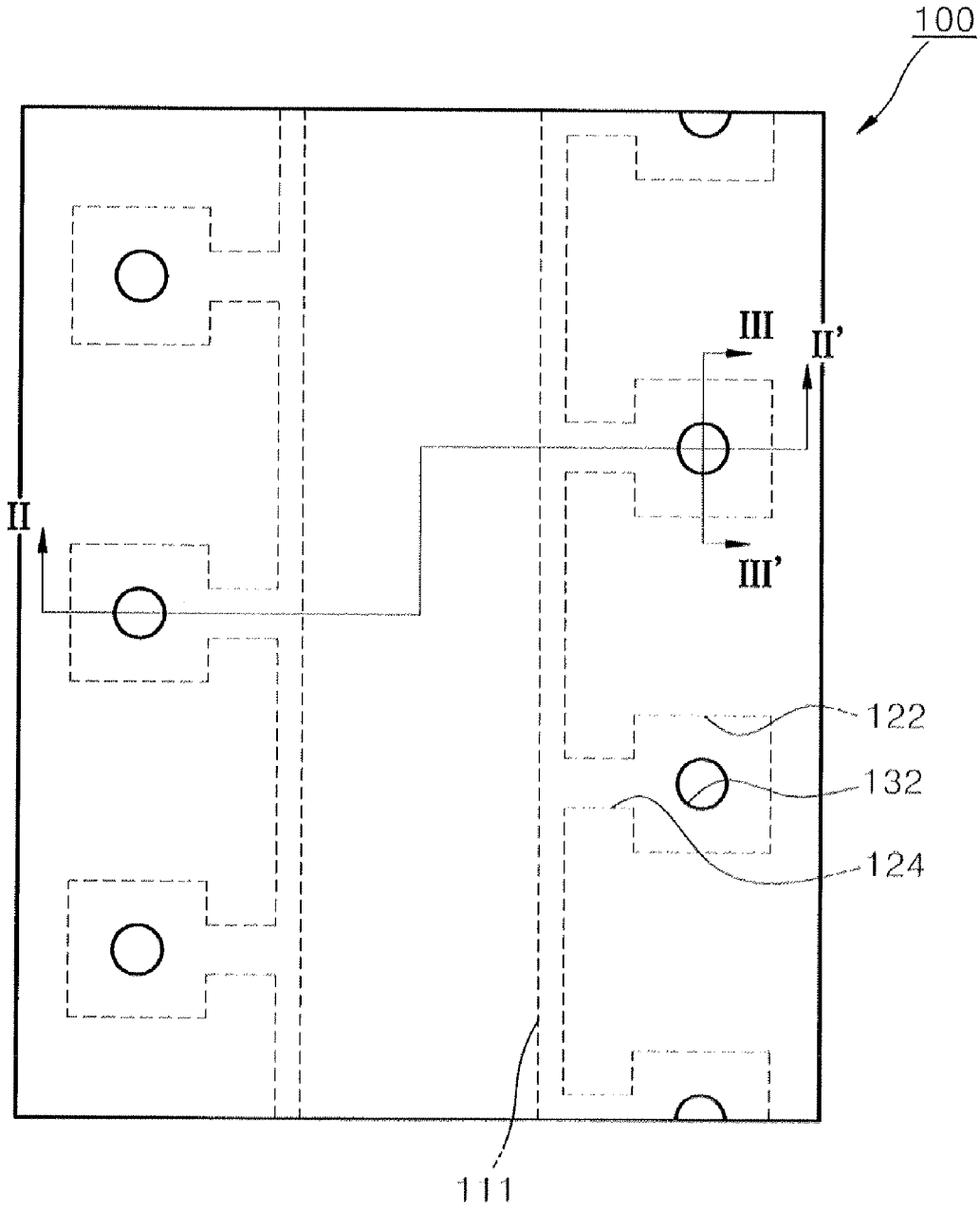
FIG. 1 is a schematic plan view illustrating a thermal inkjet printhead according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures. Size or thicknesses of constitutional elements may be exaggerated for the sake of clarity of illustration. Meanwhile, the present invention may be in many different forms and should not be construed as being limited to the embodiments set forth herein. For example, when a layer is referred to as being "on" a substrate or another layer, it can be directly on the substrate or the other layer or an intervening layer(s) may also present.

Figure 2:
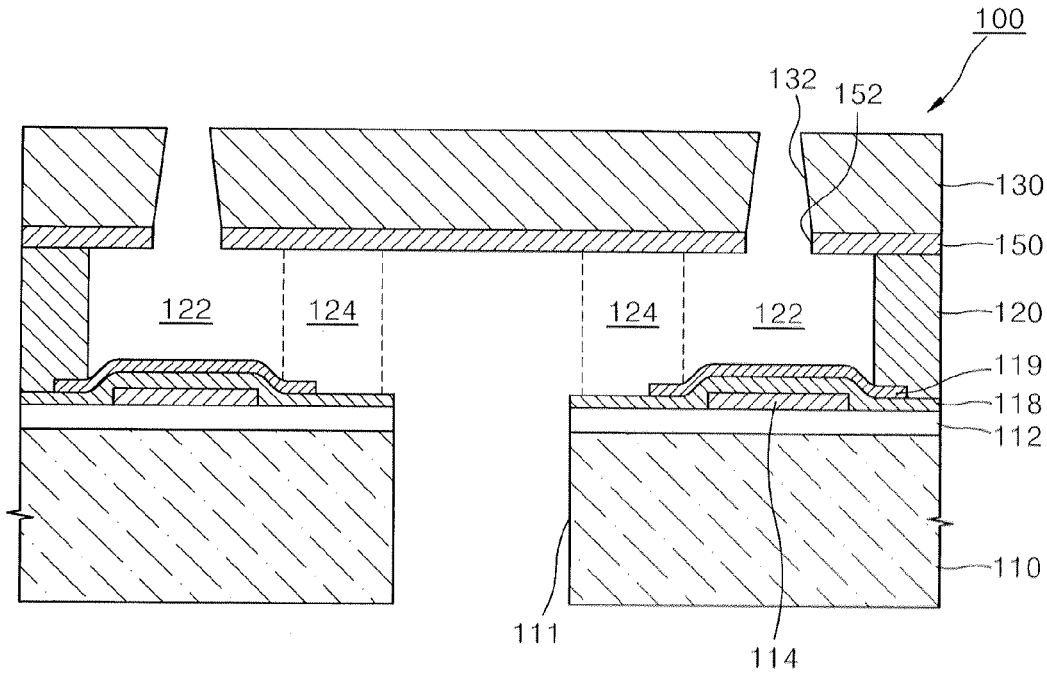
FIG. 2 is a cross-sectional view taken along a line II_II' of FIG. 1.
Figure 3:
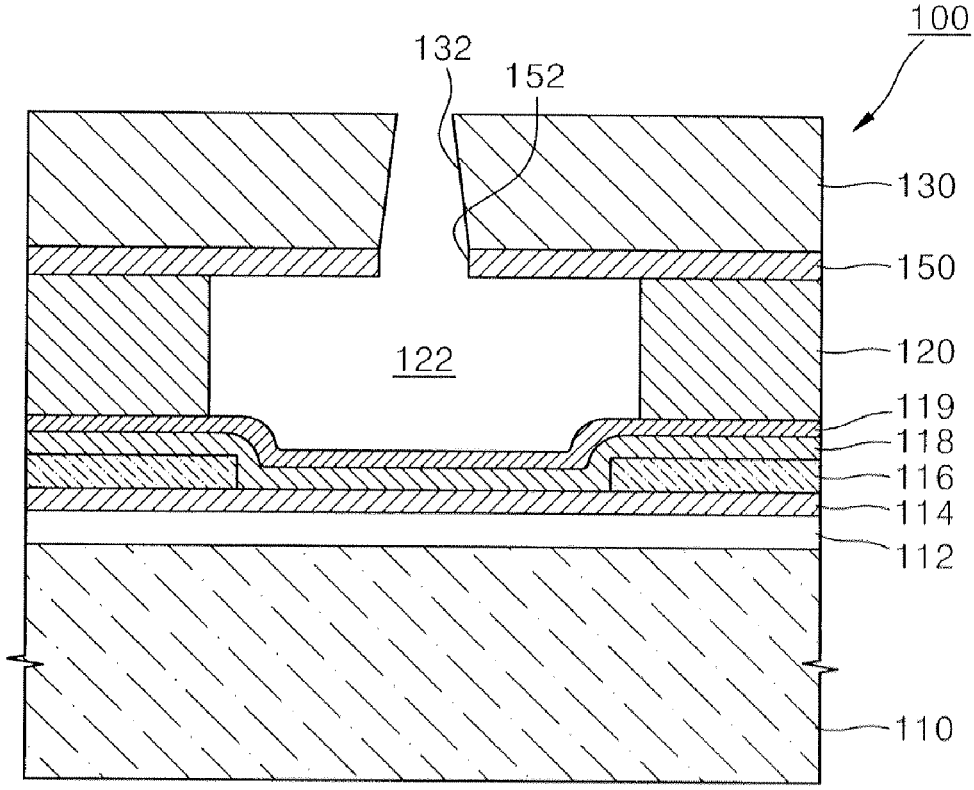
FIG. 3 is a cross-sectional view taken along a line III-III' of FIG. 1.

FIG. 1 is a schematic plan view illustrating a thermal inkjet printhead 100 according to an embodiment of the present general inventive concept. FIG. 2 is a cross-sectional view taken along a line II-II' of FIG. 1. FIG. 3 is a cross-sectional view taken along a line III_III' of FIG. 1.

Referring to FIGS. 1 through 3, a chamber layer 120, an anti reflective layer 150, and a nozzle layer 130 are sequentially formed on a substrate 110. A plurality of material layers can be formed on the substrate 110. The substrate 110 and the material layers can be collectively referred to as a substrate. The substrate 110 may be formed of, for example, silicon. An ink feed hole 111, for supplying ink, is formed through the substrate 110. A plurality of ink chambers 122, to be filled with ink supplied via the ink feed hole 111, are formed in the chamber layer 120. A plurality of nozzles 132 through which ink is ejected are formed in the nozzle layer 130. A plurality of through holes 152 are formed through the anti reflective layer 150 formed between the chamber layer 120 and the nozzle layer 130.

An insulating layer 112, for isolating and insulating the substrate 110 and from a plurality of heaters 114 to be described later, may be formed on the substrate 110. The insulating layer 112 may be formed of, for example, silicon oxide. The heaters 114, for heating ink inside the ink chambers 112 so as to generate ink bubbles, are formed on the insulating layer 112. The heaters 114 may be formed on a bottom surface of the ink chambers 122. The heater 114 may be formed of, for example, a heating resistor such as a tantalum-aluminum alloy, tantalum-nitride, titanium nitride, tungsten silicide or the like, but the present invention is not limited thereto. A plurality of electrodes 116 are formed on the heaters 114. The electrode 116 is used to apply a current to the heater 114, and is formed of a material having good conductivity. The electrode 116 may be formed of aluminum (Al), an aluminum alloy, gold (Au), silver (Ag), etc., but the present invention is not limited thereto.

The electrode can be connected to a control unit (FIG. 11) to supply a control signal or a current to the heater 114 through the electrode according to information or data corresponding to an image to be formed on a printing medium in a printing operation.

A passivation layer 118 may be formed on the heaters 114 and the electrodes 116. The passivation layer 118 prevents the heaters 114 and the electrodes 116 from contacting ink that can oxidize or corrode the heaters 114 and the electrodes 116, and may be formed of, for example, silicon nitride or silicon oxide. An anti-cavitation layer 119 may be formed on portions of the passivation layer 118, which is formed above the heater 114. The anti-cavitation layer 119 protects the heater 114 from a cavitation force that is generated when the ink bubbles collapse, and may be formed of, for example, tantalum (Ta). Although not illustrated, a glue layer may be further formed on the passivation layer 118 so that the chamber layer 120 is well attached to the passivation layer 118.

The chamber layer 120 is formed on the passivation layer 118. The ink chambers 122, to be filled with the ink supplied via the ink feed hole 111, are formed in the chamber layer 120. The ink chamber 122 may be disposed at both sides of the ink feed hole 111 along a longitudinal direction of the ink feed hole 111. A plurality of restrictors 124 may be formed in the chamber layer 120 to connect the ink feed hole 111 with the ink chambers 122. The chamber layer 120 may be formed of, for example, a photosensitive polymer.

An anti reflective layer 150, formed of a material absorbing light, may be formed on the chamber layer 120. The through holes 152 connected to the ink chambers 122 and the nozzles 132 is formed in the anti reflective layer 150. The light transmissivity of the anti reflective layer 150 may be much smaller than that of the chamber layer 120 or the nozzle layer 130. The nozzle layer 130 is formed on the anti reflective layer 150. The nozzles 132 through which ink is ejected are formed in the nozzle layer 130. The nozzle layer 130 may include a photosensitive dry film. The photosensitive dry film may be formed of, for example, a polymer. The photosensitive dry film may be a negative photoresist. The anti reflective layer 150 can be formed on the chamber layer 120 and then the nozzle layer 130 can be formed on the anti reflective layer 150 as separate layers. In this case, the anti reflective layer 150 and the nozzle layer can be sequentially formed on the chamber layer 120. However, it is possible that the anti reflective layer 150 and the nozzle layer 130 can be formed as a composite layer of the anti reflective layer 150 and the nozzle layer 130. That is, the composite layer can be formed in a film form. The composite layer may be formed on the chamber layer 120. In this case, the anti reflective layer 140 and the nozzle layer 130 can be simultaneously formed on the chamber layer 120 as the composite layer.

As described above, in the inkjet printhead according to the present embodiment, by providing the anti reflective layer 150 formed of a material to absorb light between the chamber layer 120 and the nozzle layer 130, the nozzle 132 having a uniform shape can be formed in the nozzle layer 130, which will be described later. It is also possible that the nozzle layer 130 can be a uniform thickness since the light is blocked by the anti reflective layer 150 and the light is prevented from affecting the thickness of the nozzle layer 130 during a process to form the inkjet printhead 100.

Hereinafter, a method of manufacturing the inkjet printhead 100 of FIG. 1 will be described.

FIGS. 4 through 9 are cross-sectional views illustrating a method of the inkjet printhead 100 of FIG. 1, according to an embodiment of the present general inventive concept.

Figure 4:
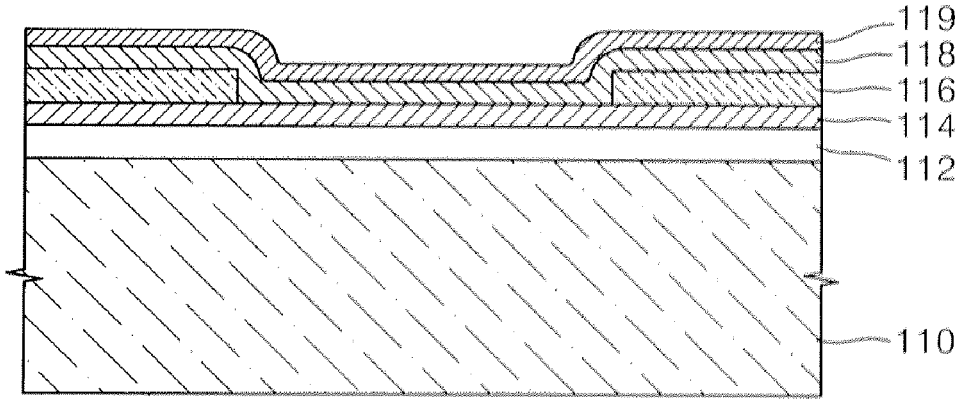
FIGS. 4 through 9 are cross-sectional views illustrating a method of the inkjet printhead of FIG. 1, according to an embodiment of the present general inventive concept.

Referring to FIG. 4, the substrate 110 is prepared, and then the insulating layer 112 is formed on the substrate 110. The substrate 110 may be formed of silicon. The insulating layer 112 insulates between the substrate 110 and the heaters 114 to be described later, and may be formed of, for example, silicon oxide. Then, the heaters 114, which heat ink to generate bubbles, is formed on the insulating layer 112. The heaters 114 may be formed by depositing a heating resistor (e.g., a tantalum-aluminum alloy, tantalum-nitride, titanium nitride, tungsten silicide, etc.) on the insulating layer 112 and then patterning the heating resistor. A plurality of electrodes 116 for applying a current to the heater 114 are formed on the heaters 114. The electrodes 116 may be formed by depositing a metal having good conductivity, such as aluminum (Al), an aluminum alloy, gold (Au), silver (Ag), etc. and then patterning the metal.

A passivation layer 118 may be formed on the insulating layer 112 so as to cover the heaters 114 and the electrodes 116. The passivation layer 118 prevents the heaters 114 and the electrodes 116 from contacting ink that can oxidize or corrode the heaters 114 and the electrodes 116, and may be formed of, for example, silicon nitride or silicon oxide. The anti-cavitation layer 119 may be further formed on portions of the passivation layer 118, which is formed above the heater 114. The anti-cavitation layer 119 protects the heater 114 from a cavitation force that is generated when the bubbles collapse, and may be formed of, for example, tantalum (Ta).

Figure 5:
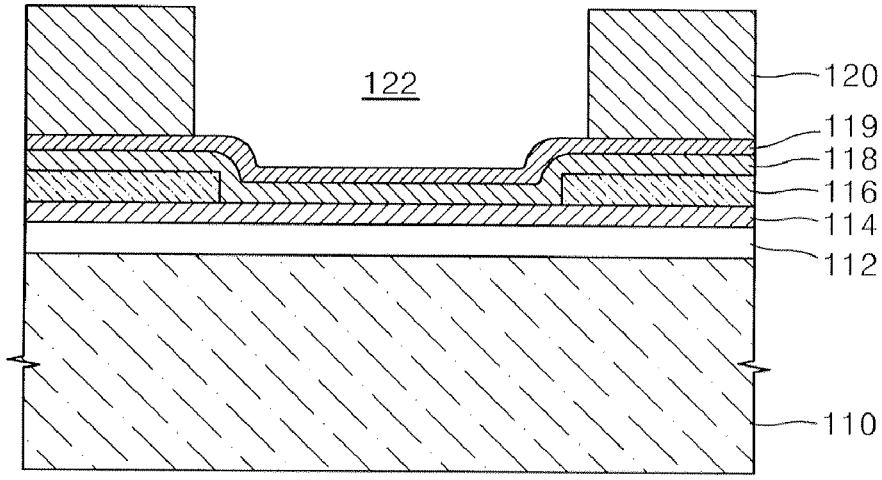

Referring to FIG. 5, the chamber layer 120 having the ink chambers 122 is formed on the passivation layer 118 and at least a portion of the anti-cavitation layer 119. The chamber layer 120 may be formed by coating a chamber material layer (not illustrated) including, for example, a liquid photosensitive polymer or a photosensitive dry film on the passivation layer 118 and at least a portion of the anti-cavitation layer 119, and then patterning the chamber material layer. Accordingly, the ink chambers 112, to be filled with ink to be ejected, are formed in the chamber layer 120. In addition, the restrictors 124 (see FIG. 1) may be formed in the chamber layer 120 to connect the ink feed hole 111 with the ink chambers 122. A glue layer (not illustrated) may be further formed on the passivation layer 118 and/or at least a portion of the anti-cavitation layer 119 prior to forming the chamber 120 so that the chamber layer 120 is well attached to the passivation layer 118 and/or at least a portion of the anti-cavitation layer 119. The glue layer may be formed of, for example, a photosensitive polymer.

Figure 6:
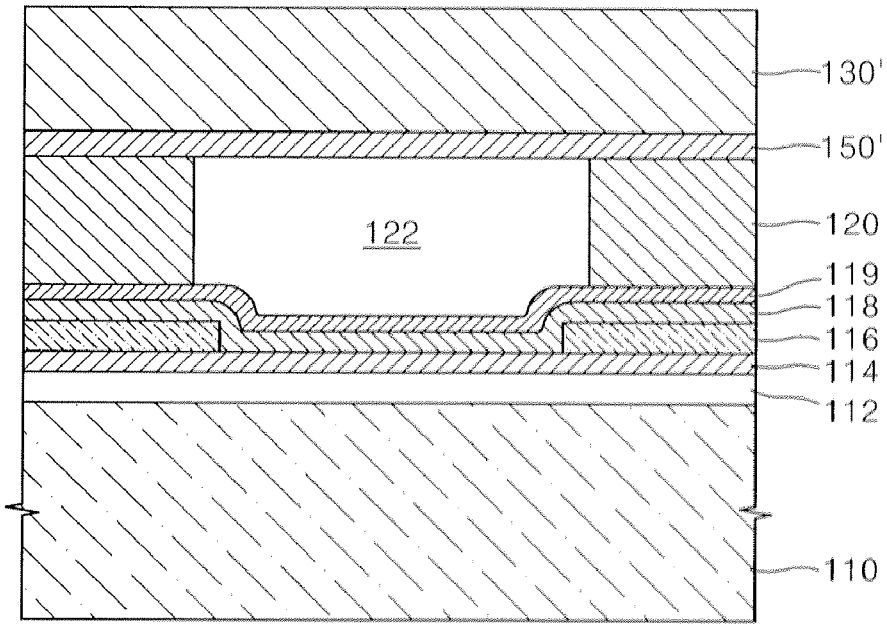

Referring to FIG. 6, an anti reflective material layer 150' and a nozzle material layer 130' are formed on the chamber layer 120. The anti reflective material layer 150' may be formed of a material absorbing light and having light transmissivity that is much lower than a material of at least one of the chamber layer 120 and the nozzle layer 130. The nozzle material layer 130' may include a photosensitive dry film. The photosensitive dry film may include a negative photoresist. The anti reflective material layer 150' and the nozzle material layer 130' may be simultaneously formed on the chamber layer 120. In particular, the anti reflective material layer 150' and the nozzle material layer 130' may be formed by laminating a composite layer, which is formed in a film form by coating the anti reflective material layer 150' on the photosensitive dry film, on the chamber layer 120. Alternatively, the anti reflective material layer 150' and the nozzle material layer 130' may be sequentially formed on the chamber layer 120.

Figure 7:
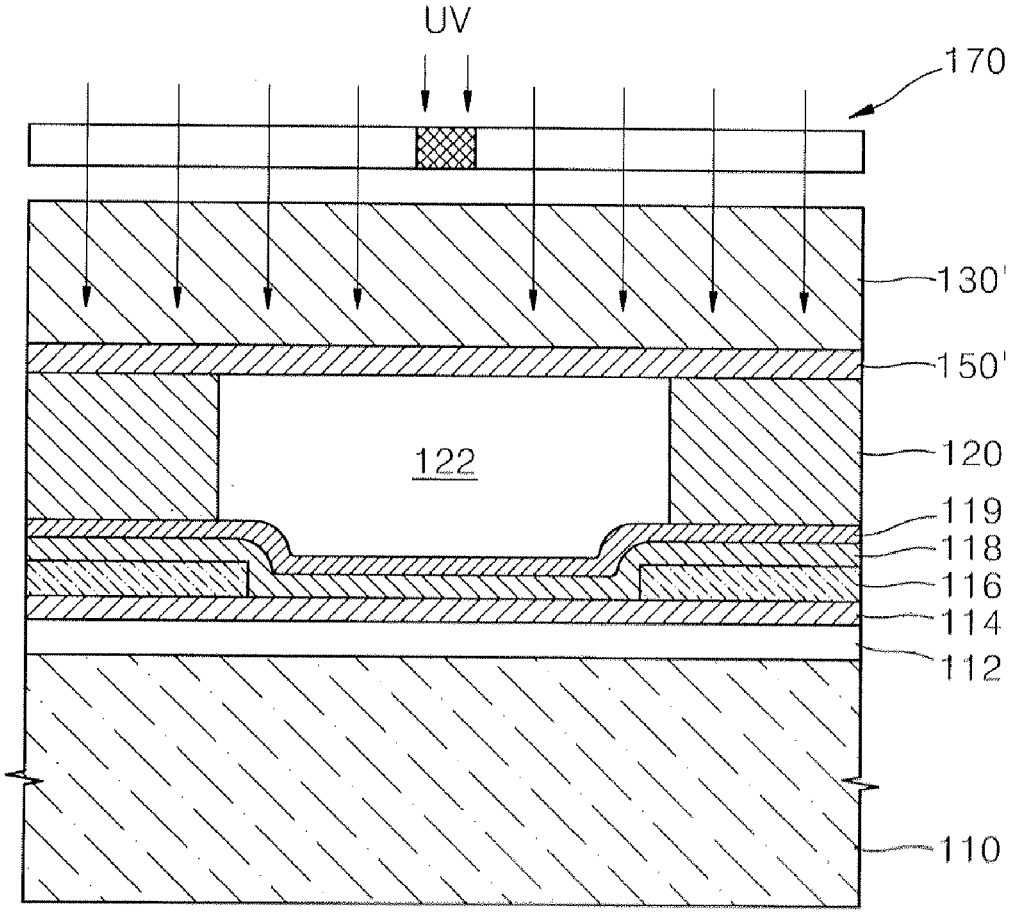

Referring to FIG. 7, the nozzle material layer 130' is exposed and developed by photolithography. In particular, a photomask 170 having a predetermined mask pattern is positioned on the nozzle material layer 130', and then ultra violet (UV) rays are radiated on the photomask 170 so as to expose the nozzle material layer 130'. Since the anti reflective material layer 150' is formed of a material absorbing light, the UV rays cannot be transmitted through the anti reflective material layer 150', and accordingly only a desired portion of the nozzle material layer 130' can be exposed. By removing a portion of the nozzle material layer 130', which is not exposed, by a developing solution, the nozzle 132 (see FIG. 8) is formed in a subsequent operation, which will be described later. Likewise, when the anti reflective material layer 150 is formed on the chamber layer 120, the nozzles 132 having a uniform shape can be formed, as described later.

Figure 10:
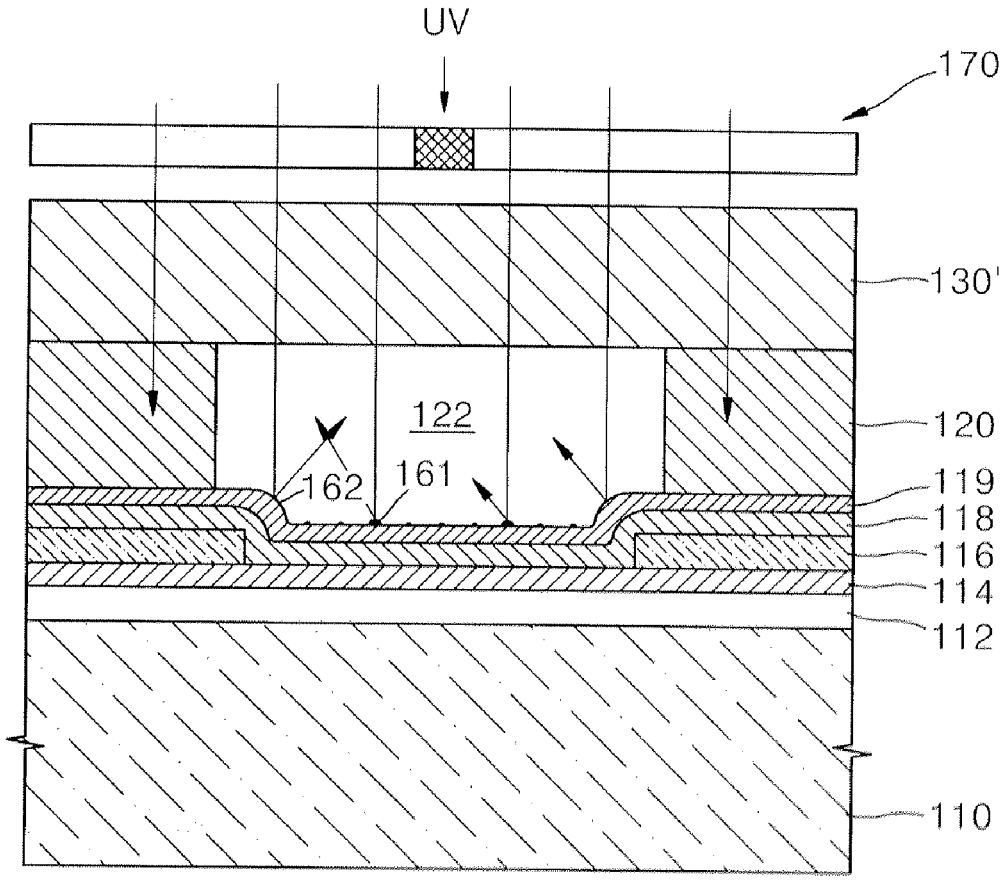
FIG. 10 illustrates a method of exposing a nozzle material layer without an anti reflective layer on a chamber layer.

FIG. 10 illustrates the case where a nozzle material layer 130' is exposed when the anti reflective material layer 150' (see FIG. 6) is not formed on a chamber layer 120. Referring to FIG. 10, if the anti reflective material layer 150' is not formed between the chamber layer 120 and the nozzle material layer 130', when the nozzle material layer 130' is exposed, light, such as UV rays transmitted through the nozzle material layer 130' are diffused-reflected on an anti-cavitation layer 119 or a layer having a diffusive and/or reflective characteristic to cause the reflected light to affect another layer, for, example, the nozzle material layer 130'. In particular, when an electrode material formed on a heater 114 is patterned when forming an inkjet printhead, an end of an electrode is formed with a step difference. Thus, a step difference 162 is also generated on a portion of the anti-cavitation layer 119, which corresponds to the end of the electrode 116. In addition, the electrode 116 is formed of aluminum that might include impurities such as silicon, copper, etc. When the electrode 116 is formed by patterning the electrode material, aluminum is removed by wet etching. At this time, impurities such as silicon, copper, etc., remain on the heater 114. Since a passivation layer 118 and the anti-cavitation layer 119 are sequentially formed on the heater 114 in subsequent operations, protrusions 161 corresponding to the impurities remaining on the heater 114 are formed on the anti-cavitation layer 119.

Likewise, when the protrusions 161 or the step difference 162 is formed on the anti-cavitation layer 119, UV rays transmitted through the nozzle material layer 130' are diffused-reflected during the exposing of the nozzle material layer 130' due to the step difference 162 or the protrusions 161. Since an inappropriate portion of the nozzle material layer 130' is also exposed due to the diffused-reflected UV rays, a nozzle having an uneven shape might be formed.

However, according to the present embodiment, as illustrated in FIGS. 4 through 9, when the anti reflective material layer 150' is formed of a material absorbing light and disposed on the chamber layer 120, UV rays transmitted through the nozzle material layer 130' can be blocked by the anti reflective material layer 150' during the exposing of the nozzle material layer 130'. Thus, since a desired portion of the nozzle material layer 130' can be exposed, the nozzle 130 having a uniform shape (e.g., a predetermined diameter) can be formed.

Figure 8:
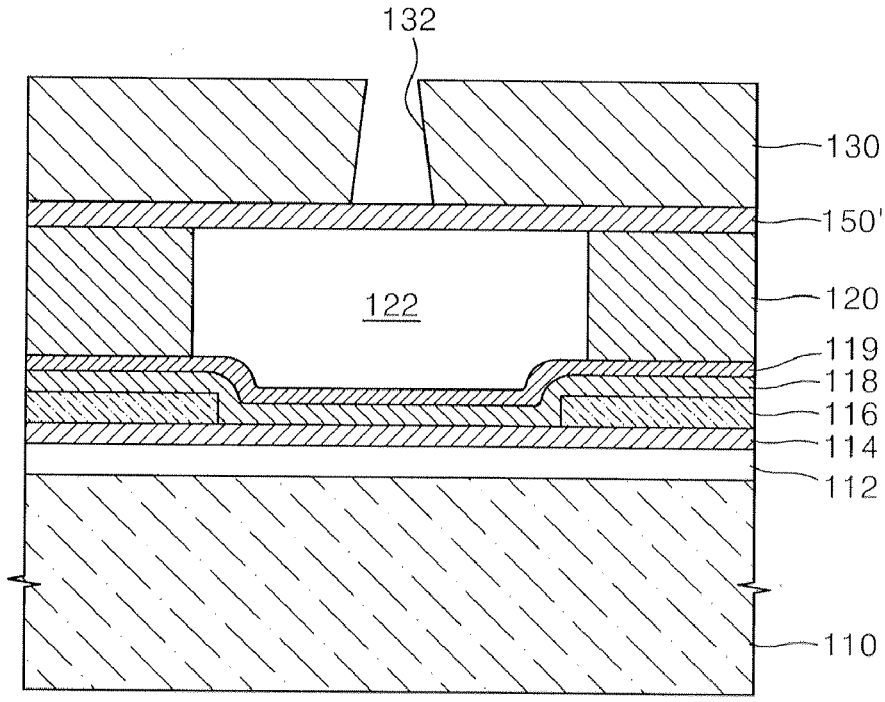
Figure 9:
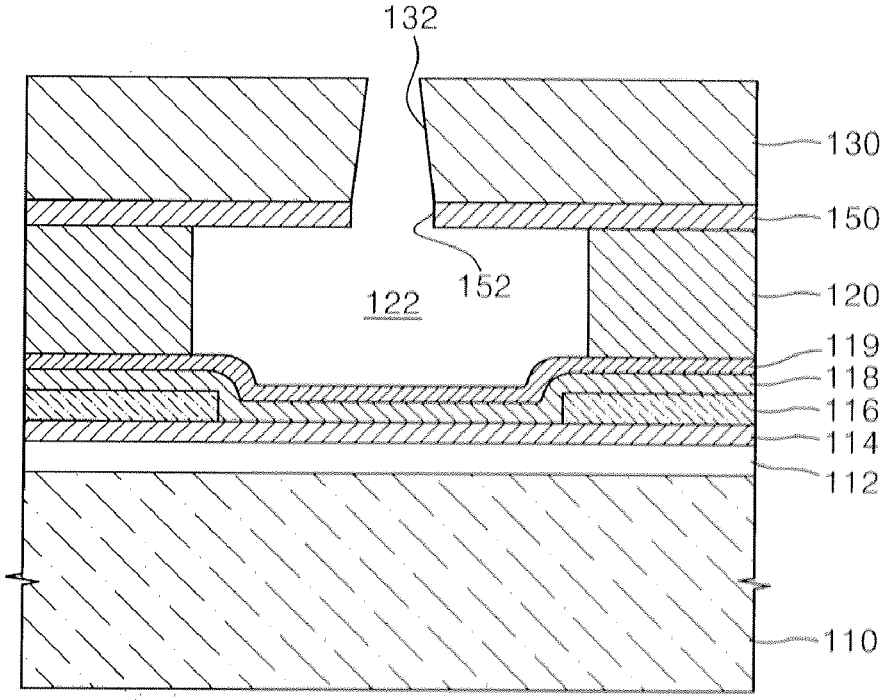

Referring to FIG. 8, the nozzle layer 130 having the nozzles 132 is formed on the anti reflective material layer 150' by exposing the nozzle material layer 130' and then developing the nozzle material layer 130'. Referring to FIG. 9, the anti reflective layer 150 having a plurality of through holes 152 therethrough is formed by removing the anti reflective material layer 150' formed below the nozzles 132 by dry etching or wet etching. The through holes 152 are connected to the ink chambers 122 and the nozzles 132. In dry etching, ashing with oxygen plasma may be used, for example. In wet etching, a predetermined developing solution that can develop only the anti reflective material layer 150' may be used. As described so far, only the case of forming the anti reflective layer 150, including forming the nozzle layer 130 by developing the nozzle material layer 130' and then removing a portion of the anti reflective material layer 150', which is exposed through the nozzles 132, has been described. However, in the present embodiment, during the developing a portion of the nozzle material layer 130', which is not exposed, a portion of the anti reflective material layer 150', formed below the portion of the nozzle material layer 130', may also be developed. In this case, the nozzle layer 130 and the anti reflective layer 150 can be simultaneously formed by exposing and developing the nozzle material layer 130'.

In the meantime, the ink feed hole 111 (see FIG. 1), for supplying ink to the ink chambers 122, may be formed in the substrate 110 in an early stage or a late stage of a process of manufacturing an inkjet printhead. For example, the ink feed hole 111 may be formed through the substrate 110 prior to forming the chamber layer 120 on the substrate 110, or alternatively the ink feed hole 111 may be formed in the substrate 110 after forming the nozzle layer 130.

Figure 11:
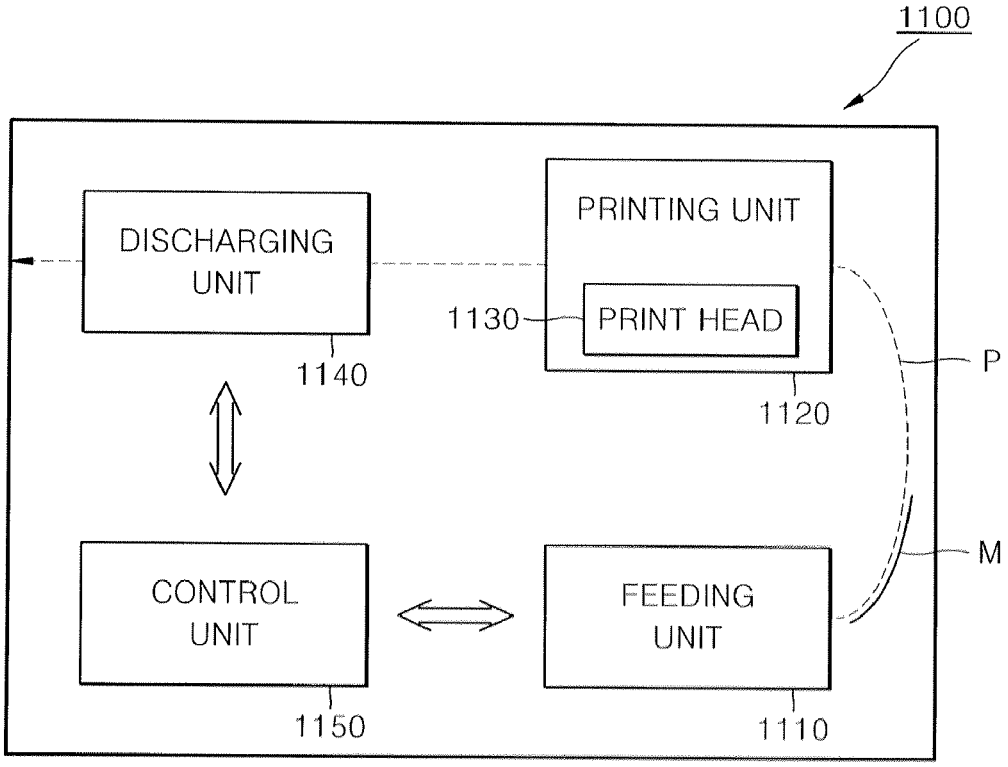
FIG. 11 is a view illustrating an image forming apparatus having an inkjet printhead according to an embodiment of the present general inventive concept.

FIG. 11 is a view illustrating an image forming apparatus 1100 according to an embodiment of the present general inventive concept. Referring to FIGS. 1-3 and 11, the image forming apparatus 1100 includes a feeding unit to feed a printing medium M along a path P, a printing unit 1120 having an inkjet printhead 1130 to form an image on the printing medium M, a discharging unit to discharge the printing medium M, and a control unit to control the above described units to perform a printing operation so that the image can be formed on the printing medium M. It is possible that the control unit 1150 may have an interface to communicate with an external device through a wired or wireless communication line to receive data corresponding to the image. The external device may be another image forming apparatus, a personal computer, a device connected to the control unit 1150 through a network, a scanning device to scan a document to generate the data. The inkjet printhead 100 of FIG. 1 can be used as the inkjet printhead 1130 of FIG. 11. The inkjet printhead 1130 may further include an ink cartridge with an ink storage to supply the ink to the inkjet printhead 110 through the feed hole 111.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet printhead comprising:

a substrate;

a chamber layer formed on the substrate and including a plurality of ink chambers;

an anti reflective layer formed on the chamber layer, the anti reflective layer formed of a material that absorbs light; and a nozzle layer formed on the anti reflective layer and including a plurality of nozzles, wherein a light transmissivity of the anti reflective layer is smaller than a light transmissivity of the chamber layer or the nozzle layer.

2. The inkjet printhead of claim 1, wherein the anti reflective layer comprises a plurality of through holes formed therethrough and connected to the nozzles.

3. The inkjet printhead of claim 1, wherein the nozzle layer comprises a photosensitive dry film.

4. The inkjet printhead of claim 3, wherein the photosensitive dry film comprises a negative photoresist.

5. The inkjet printhead of claim 1, wherein the chamber layer comprises a photosensitive polymer.

6. The inkjet printhead of claim 1, wherein a composite layer of the anti reflective layer and the nozzle layer, which is manufactured in a film form, is formed on the chamber layer.

7. The inkjet printhead of claim 1, further comprising an ink feed hole supplying ink to the ink chamber and formed in the substrate.

8. The inkjet printhead of claim 1, further comprising:

an insulating layer formed on the substrate;

a plurality of heaters and a plurality of electrodes, sequentially formed on the insulating layer; and a passivation layer formed so as to cover the heaters and the electrodes.

9. The inkjet printhead of claim 8, further comprising an anti-cavitation layer formed on the passivation layer and protecting the heater from a cavitation force generated when bubbles collapse.

10. A method of manufacturing an inkjet printhead, the method comprising:

forming a chamber layer having a plurality of ink chambers on a substrate;

stacking an anti reflective material layer and a nozzle material layer on the chamber layer, the anti reflective layer formed of a material that absorbs light; and forming a nozzle layer including a plurality of nozzles and an anti reflective layer including a plurality of through holes, wherein a light transmissivity of the anti reflective material layer is smaller than a light transmissivity of the chamber layer or the nozzle layer.

11. The method of claim 10, wherein the chamber layer is formed by forming a chamber material layer including a liquid photosensitive polymer or a photosensitive dry film and patterning the chamber material layer.

12. The method of claim 10, wherein the nozzle material layer comprises a photosensitive dry film.

13. The method of claim 12, wherein the photosensitive dry film comprises a negative photoresist.

14. The method of claim 10, wherein the stacking of the anti reflective material layer and the nozzle material layer comprises laminating a composite layer of the anti reflective material layer and the nozzle material layer, which is manufactured in a film form, on the chamber layer.

15. The method of claim 10, wherein the forming of the nozzle layer and the anti reflective layer comprises:

forming the nozzle layer including the nozzles by exposing and developing the nozzle material layer; and forming the anti reflective layer including the through holes connected to the nozzles by removing the anti reflective material layer exposed through the nozzles.

16. The method of claim 10, wherein the forming of the nozzle layer and the anti reflective material layer comprises forming the nozzle layer including the nozzles and the anti reflective layer including the through holes connected to the nozzle by exposing and developing the nozzle material layer.

17. The method of claim 10, further comprising:

forming an insulating layer on the substrate;

sequentially forming a plurality of heaters and a plurality of electrodes on the insulating layer; and forming a passivation layer so as to cover the heaters and the electrodes.

18. The method of claim 17, further comprising forming an anti-cavitation layer on the passivation layer.

19. An image forming apparatus comprising:

a feeding unit to feed a printing medium along a path;

a printing unit including a print head having a substrate, a chamber layer formed on the substrate and including a plurality of ink chambers, an anti reflective layer formed on the chamber layer, the anti reflective layer formed of a material that absorbs light, and a nozzle layer formed on the anti reflective layer and including a plurality of nozzles, and to form an image on the printing medium; and a discharge unit to discharge the printing medium, wherein a light transmissivity of the anti reflective layer is smaller than a light transmissivity of the chamber layer or the nozzle layer.

20. An inkjet printhead comprising:

a substrate;

a chamber layer formed on the substrate to form an ink chamber;

a nozzle layer formed on the chamber layer; and an anti reflective layer formed of a material having a light reflecting characteristic between the chamber layer and the nozzle layer, and a light transmissivity that is smaller than a light transmissivity of the chamber layer or the nozzle layer.

21. An inkjet printhead comprising:

a nozzle layer having a nozzle; and an anti reflective layer attached to the nozzle layer to reflect light passing the nozzle layer back toward the nozzle layer, the anti reflective member having a light transmissivity that is smaller than a light transmissivity of the nozzle layer.

22. An inkjet printhead comprising:

a nozzle layer having a nozzle; and an anti reflective layer formed on the nozzle layer and having a light reflecting characteristic different from a light transmitting characteristic of the nozzle layer, wherein a light transmissivity of the anti reflective layer is smaller than a light transmissivity of the nozzle layer.

23. An inkjet printhead comprising:

a chamber layer;

a nozzle layer having a nozzle and to define an ink chamber with the nozzle layer; and an anti reflective layer to reflect light having a light transmissivity that is smaller than a light transmissivity of the chamber layer or the nozzle layer such that the light passing the nozzle layer is prevented from being incident into the ink chamber.

* * * * *